United States Patent [19]

Burkhardt, Jr.

[11] Patent Number: 4,717,275

[45] Date of Patent: Jan. 5, 1988

[54] WRITING INSTRUMENT WITH A RETRACTABLE CLIP

[76] Inventor: Dietmar Burkhardt, Jr., 109 Quarry La., Santa Cruz, Calif. 95060

[21] Appl. No.: 876,917

[22] Filed: Jun. 20, 1986

[51] Int. Cl.[4] ..... B43K 21/06; B43K 24/04; B43K 24/12; B43K 27/00

[52] U.S. Cl. ..... 401/104; 401/106; 401/30; 401/84

[58] Field of Search ..... 401/82, 83, 84, 105, 401/104, 106, 17, 29, 30, 32, 103, 109, 99

[56] References Cited

U.S. PATENT DOCUMENTS

| | | | |
|---|---|---|---|
| 1,150,068 | 8/1915 | Schroeder . | |
| 2,427,069 | 9/1947 | Randolph | 401/104 |
| 2,583,142 | 1/1952 | Frentzel | 401/106 |
| 2,833,251 | 5/1958 | Boyle | 120/14.5 |
| 3,203,402 | 8/1965 | Lockwood | 401/106 |
| 3,288,116 | 11/1966 | Poritz | 120/42.1 |
| 3,985,455 | 10/1976 | Wahlberg | 401/30 |
| 4,227,822 | 10/1980 | Kokubu | 401/17 |
| 4,290,707 | 9/1981 | Ariga | 401/110 |
| 4,352,579 | 10/1982 | Yi | 401/19 |

FOREIGN PATENT DOCUMENTS

| | | | |
|---|---|---|---|
| 98673 | 3/1964 | Denmark . | |
| 433810 | 12/1924 | Fed. Rep. of Germany . | |
| 1075981 | 2/1960 | Fed. Rep. of Germany | 401/109 |
| 107643 | 12/1923 | Switzerland . | |
| 13640 | 8/1980 | United Kingdom . | |

*Primary Examiner*—Richard J. Apley
*Assistant Examiner*—Franklin Gubernick

[57] ABSTRACT

A writing instrument having a casing with an axially-extending bore seating a cantilevered arm of a pocket clip which protrudes through the casing bore when the instrument is in an "off" position. The pocket clip has guide tabs which fit into guide channels in the instrument's casing. The guide channels, with spring fingers which bias the pocket clip in the direction of the bore, are capable of releasably locking the clip in plural positions. In the "off" position the pocket clip arm protrudes through the casing aperture but the writing members housed within the casing are retracted. Moving the pocket clip to a "write" position causes a writing member to project from either the front or back of the housing and the pocket clip arm to be retracted into the casing.

15 Claims, 9 Drawing Figures

WRITING INSTRUMENT WITH A RETRACTABLE CLIP

DESCRIPTION

1. Technical Field

The invention relates to writing instruments and particularly to improvements in lead and ballpoint writing instruments with retractable writing nibs.

2. Background Art

Typically, a writing instrument, such as a pen or a mechanical pencil, contains a tip or nib which may be releasably locked into a "write" position during operation and returned to an "off" position for storage. Writing instruments are provided with pocket clips for securing the unit in the pocket of a purse or clothing. However, an instrument which is stored in a pocket before being returned to an "off" position will leave a mark and, if ballpoint pen leakage occurs, sometimes ruin the purse or clothing.

At times a person will use a pen and a pencil alternatively. In other instances pens of varyign colored ink are needed. It would be beneficial to have a writing instrument capable of projecting and retracting writing members of different colors or of different kinds.

Writing instruments having a plurality of writing members are known. For example, U.S. Pat. Nos. 4,352,579 to Yi, 4,290,707 to Ariga, 4,227,822 to Kokubu, 3,985,455 to Wahlberg, 3,288,116 to Poritz, 2,833,251 to Boyle and 1,150,068 to Schroeder all teach multiple writing members. The same is true to British Pat. No. 13,640 to Nightingale, Swiss Pat. No. 107,643 to Kuster and German Pat. No. 433,810 to Kuster. However, none of these inventions teach a method of preventing accidental markings of pockets. Danish Pat. No. 98,673 to Sheaffer teaches a lock-down pocket clip but does not teach multiple-unit capability.

An object of the present invention is to provide a writing instrument having a retractable member which prevents the potentially destructive storage of a writing instrument in the pocket of a purse or clothing while the writing member is in a "write" position. A further object is to provide such a pen with multiple-unit capabilities at a cost that is inexpensive to produce.

DISCLOSURE OF INVENTION

The above objects have been met through the use of a pocket clip which automatically retracts a pen nib or other writing member when the writing implement is placed in the pocket. The pocket clip is linked to the writing medium and controls retraction of the writing member into the casing of the writing instrument.

The instrument's casing contains an axially-extending bore at least as long as an arm of the pocket clip. The clip has guide tabs protruding from each side and the guide tabs fit into guide channels in the instrument's casing.

The instrument's guide channels are capable of securing the clip in various positions. In an "off" position the instrument cannot be used to write but the arm of the pocket clip projects from the casing so that the clip may be used to secure the instrument to another object. In a first "write" position the clip is pushed downward and forward until it is secured by a stop in the guide channels. The result is that the clip is held down and a writing member projects from the front of the pen. Spring fingers are used to bias the clip upward in order to lock the clip into position.

If a writing instrument has a second writing member the guide channels are such that the clip may be pushed downward and then backward to project the tip of the second writing member from the rear of the instrument. In this second "write" position the clip is once again locked in a retracted position.

Because the projection of a writing member from the front or rear of an instrument coincides with the retraction of the pocket clip, the clip cannot be used until the instrument has been returned to an "off" position. Thus, in comparison to the conventional pen, the present invention is much less likely to mark or damage clothing or a purse. Furthermore, the multiple unit capacity of the instrument eliminates any need for carrying two separate scribing instruments.

BEST MODE FOR CARRYING OUT THE INVENTION

Figure 1:
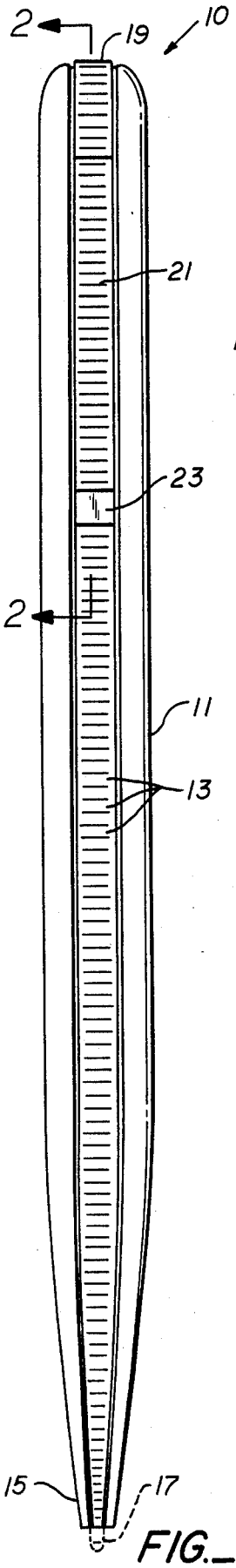
FIG. 1 is a side view of a writing instrument in accordance with the present invention.

With reference to FIG. 1, a writing instrument 10 is shown to include a casing 11 with decorative gripping members 13. The casing 11 has a tapered front end 15. In phantom, the tip 17 of an ink tube is shown protruding from front end 15. The writing instrument of FIG. 1 contains a single writing member and for this reason the instrument has a blunt back end 19. As will be explained with reference to FIG. 6, the back end of a multiple membered instrument is tapered, much like the front end 15.

FIG. 1 shows an arm 21 of a pocket clip in an "off" position. That is, the arm is pushed rearward, leaving a large gap 23 between the pocket clip arm 21 and the front portion of the casing 11. The arm 21 contains decorative ribs 13 identical to those of the casing.

Figure 2:
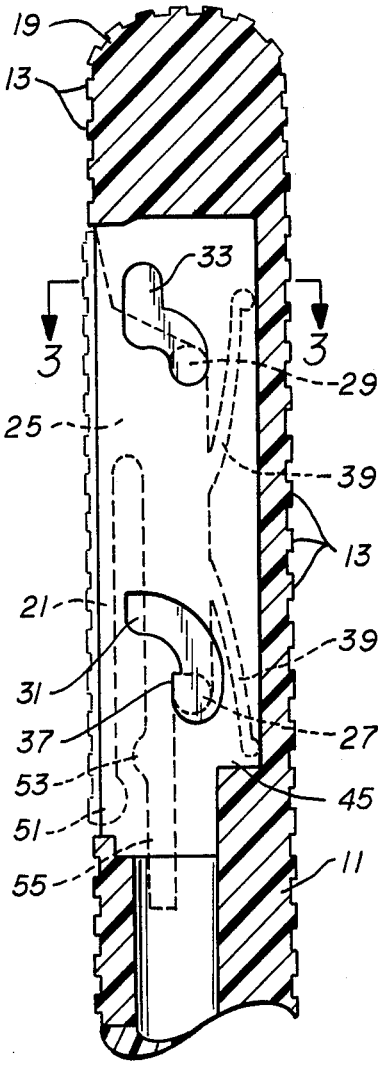
FIG. 2 is a side sectional view of the upper portion of the present invention taken along lines 2—2 of FIG. 1.

With reference to FIG. 2, a pocket clip 25 is shown in phantom. The pocket clip 25 is in a "write" position. In the "write" position the arm of the pocket clip 21 in actually becomes part of the instrument's casing 11.

On each side of the pocket clip 25 are a front guide tab 27 and a rear guidie tab 29. Each front guide tab 27 into a front guide channel 31 in the sides of an axial bore extending through most of the interior of the instrument's casing 11. The rear guide tabs 29 fit into rear guide channels 33. The guide channels 31, 33 may be cut into the sides of the plastic casing 11 or may be part of plates which are fixed to the casing in some way.

The front guide channels 31 have an arcuate shape. As the pocket clip 25 is pushed downward, the channels bring the clip forward. When a squared edge 35 of the front guide tab makes contact with a stop 37 on the guide channels the pocket clip is locked in place. Spring fingers 39 provide an upward bias to the pocket clip in order to secure the clip's positioning. The stop 37 is an upward indentation in the guide channel which, together with the spring bias, secures the tabs in a "write" position.

The rear guide channels 33 have a back portion which is parallel to the arm 21 of the pocket clip. Thus, should a user grasp the writing instrument by the pocket clip arm while removing the instrument from a pocket, the instrument will not be inadvertently placed in a "write" position which could mark the pocket. The forward portion of the rear guide channels has an arcuate shape which allows the clip to be lowered into the casing until the arm 21 is flush with the casing.

Figure 3:
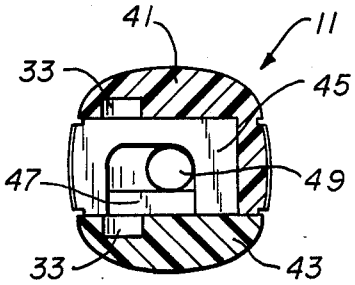
FIG. 3 is a sectional view taken along lines 3—3 of FIG. 2.

FIG. 3 illustrates the construction of the casing 11 viewed from the position indicated by lines 3—3 of FIG. 2. The casing consists of two elongated pieces 41, 43. Pins, not shown, are used to hold the two pieces together while allowing the pieces to be separated to refill the writing unit. The method of attaching the two pieces is not critical.

FIGS. 2 and 3 show that the larger casing piece 41 has a lip 45 which begins beyond the point at which it can possibly hinder the pocket clip 25. The smaller piece 43 also has a lip 47 but, unlike lip 45, it begins only at the extreme tip of the instrument. Lips 45, 47 are utilized to ensure that the writing unit is centered within the casing.

Guide channels 31, 33 may be cut into the casing 11, as in FIG. 3, or may be part of channel plates that are glued to pieces 41, 43. The center hole 49 at the end of the instrument must have a diameter sufficiently large to permit the tip of a writing unit to exit.

Figure 4:
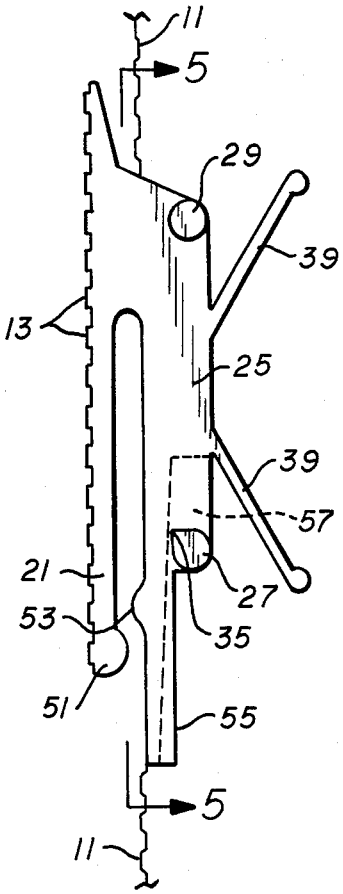
FIG. 4 is a side view of a pocket clip member detail related to FIG. 2.
Figure 5:
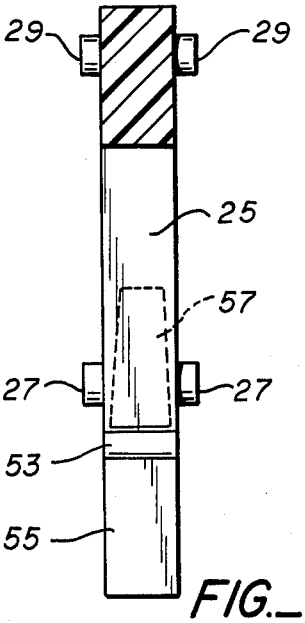
FIG. 5 is a sectional view of the pocket clip of FIG. 4 taken along lines 5—5.

With reference to FIGS. 4 and 5, a knob 51 at the end of the pocket clip arm 21 applies pressure to the outside of a purse or clothing pocket. A protrusion 53 on a cantilevered section 55 of the clip applies pressure to the inside of the pocket. In this way the instrument may be stored securely but may be extracted easily.

In operation, an eyelet 57 in the pocket clip accepts the end of a writing member, not shown. While in the "off" position the arm 21 is high in relation to the casing 11. But by applying downward and forward pressure to the pocket clip, the arm retracts into the casing until the guide tabs reach the stop of the guide channels. At that point the clip is releasably locked into place with the clip arm flush with the casing. The forward motion pushes the tip of the writing unit from the casing so that the instrument is in a "write" position. The instrument may be returned to an "off" position by providing the pocket clip with an initial downward pressure followed by a rearward pressure. A spring, not shown, at the tip of the writing unit returns the writing member to the "off" position. The positioning of the spring at the tip of the unit is well known by persons skilled in the art.

Figure 6:
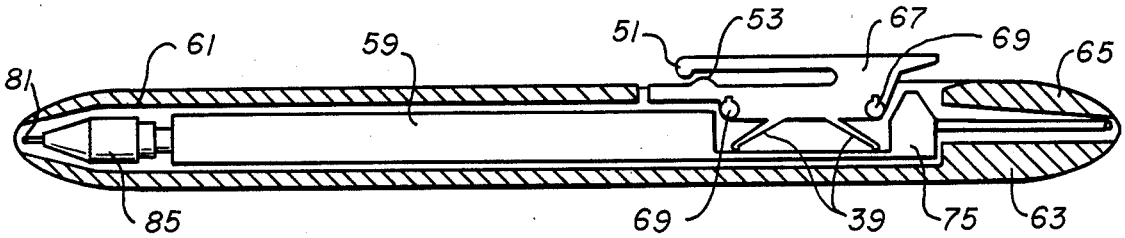
FIG. 6 is a side sectional view of the instrument of FIG. 1 having two writing units.

FIG. 6 illustrates a writing instrument housing both a mechanical pencil and a ballpoint pen. An inner housing tube 59 of a mechanical pencil is located in the forward portion 61 of the instrument. An ink supply tube 63 is housed in the rear portion 65 of the instrument.

Pocket clip 67 actuates the writing units 59, 63. Clip 67 contains a number of features identical to the clip of FIG. 4. Arm 21 extends outside of the instrument whenever the clip is in an "off" position. Knob 51 and protrusion 53 provide pressure to the outside and inside of a pocket, respectively. Spring fingers 39 upwardly bias the clip.

Figure 7:
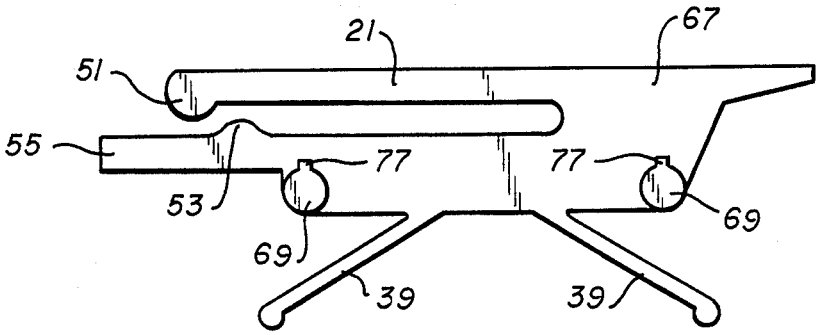
FIG. 7 is a side view of a pocket clip member detail related to FIG. 6.
Figure 8:
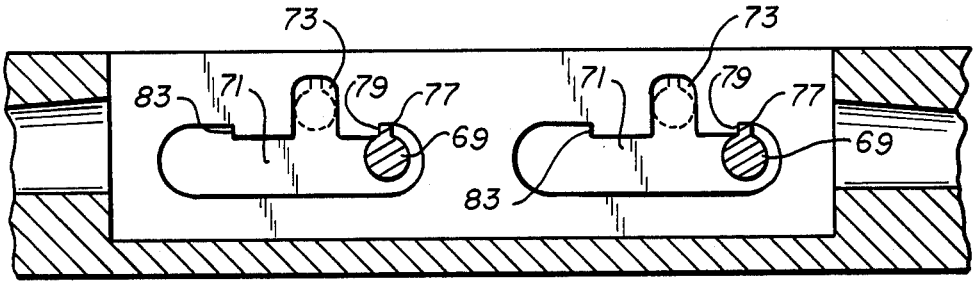
FIG. 8 is a side view of the guide channels of FIG. 6.
Figure 9:
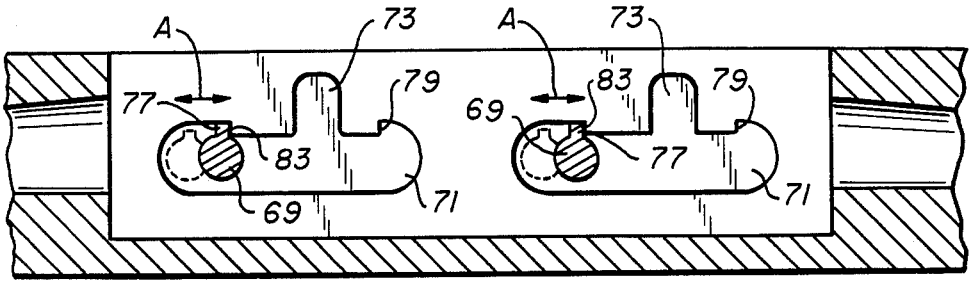
FIG. 9 is a side view of the guide channels of FIG. 8 illustrating use of a writing medium.

FIGS. 7–9 illustrate the pocket clip 67 in operation. Guide tabls 69 fit into guide channels 71. In an "off" position the guide tabs 69 are in a raised position in the upwardly-extending passage 73 of the guide channels. FIG. 8 illustrates, in phantom, the "off" position of the guide tabs.

Guide tabs 69 are biased upwardly by spring fingers 39. However, a user may place the tabs in a second "write" position by exerting a downward pressure on the pocket clip arm 21, followed by a rearward motion. The downward pressure forces the guide tabs from passageway 73 and causes the clip arm to retract into the casing of the instrument. Because the rearward edge of the pocket clip has a shape geometrically similar to that of an ink tube block 75, the rearward motion extends the tip of the ink tube 63 from the instrument. The pocket clip is releasably locked in the second "write" position, as seen in FIG. 8, when a latch 77 at the apex of guide tabs 69 comes in contact with a stop 79 on guide channels 71. Once again the guide channel stop is an upward indentation in the guide channel.

The writing instrument may be placed in a first "write" position by a downward force on the pocket clip 67, which once again compresses spring fingers 39, followed by a forward motion. The forward motion traps the mechanical pencil's inner housing tube 59 against the lower edge of the cantilevered section 55 and the body of the clip. As a result, the tip of the ink tube 63 and the clip arm 67 are retracted into the instrument while the tip 81 of the pencil is extended from the instrument. The clip is releasably locked in the first "write" position, similar to the second "write" position, by the interaction of the spring finger bias, the guide tab catch 77 and a stop 83.

The portion of the guide channel 71 associated with the mechanical pencil is elongated so that additional lead may be extracted from the pencil. Pushing the pocket clip forward brings the guide tabs to the position shown in phantom in FIG. 9. As a result, the inner housing tube 59 moves forward. A collet activation cap 85, when pressed against the inner walls of the instrument, causes the lead to be extracted from the pencil's tip 81. this lead extraction motion is indicated by Arrows A in FIG. 9.

Again, the guide channels 71 may be cut into the casing of the instrument or may be part of channel plates ehich are fitted to the casing. It is understood that changes to the design of the guide channels, which result in channels that are functionally equivalent to the present design, are within the scope of the present invention. For example, rather than the guide channel stops the channels may be arced upwardly at the ends.

Inner housing tube 59 may be used to store extra lead and ink tubes. The tube is typically press fit to the pocket clip and is made of plastic, but this construction is not critical.

I claim:

1. A writing instrument comprsing, at least one writing member, a tubular casing housing said writing member, said casing having a casing axis and an axially-extending lateral slot and having a front end and a back end, said front end having an opening, a slidable pocket clip having a cantilevered arm retractably extending from said lateral slot parallel to said casing axis, said writing member being in contact with said pocket clip, said pocket clip having a plurality of guide tabs , said cantilevered arm extending from a first side of said pocket clip and said guide tabs extending from at least one side of said pocket clip perpendicular to said first side, structure having recesses defining recessed guide channels associated with said casing, said guide channels disposed to slidably accept said guide tabs whereby motion of said pocket clip moves said writing member in an axial direction, said guide channels having a configuration to secure said socket clip in at least two positions including a first write position wherein said cantilevered arm is retracted into said lateral slot and a first writing member extends from said opening of said front end, and a biasing means for urging said pocket clip in a direction substantially perpendicular to said casing axis to releasably lock said pocket clip in said positions.

2. The instrument of claim 1 wherein said biasing means includes at least one spring member biasing said pocket clip toward said lateral slot, said spring member being the sole biasing means.

3. The instrument of claim 1 wherein said guide channels include at least one forward guide channel and at least one rearward guide channel, said forward guide channel having a first write position stop and an arcuate shape extending away from said lateral slot and toward said first writing member and said first write position stop, said rearward guide channel having a back portion parallel to said cantilevered arm and a front arcuate portion extending from said front portion and toward said first writing member.

4. The instrument of claim 1 wherein said first writing member is an ink tube.

5. The instrument of claim 3 wherein said first writing member is a pencil member and said guide channels are elongated in a direction parallel to the casing axis, thereby increasing the distance from the guide channel ends nearest to the first writing member to the first write position stop.

6. The instrument of claim 5 having a second writing member with an ink tube, said back end of the casing having an opening, said guide channels each having a first passage parallel to said casing axis, said first passages each having a first means for securing said pocket clip in said first write position and having a second means for securing said pocket clip in a second write position wherein said cantilevered arm is retracted into said casing and said second writing member extends from said opening in the back end of the casing, said guide channels each having a second passage extending in a direction toward said lateral slot and perpendicular to said first passage beginning at a point between said first means and said second means for securing said pocket clip.

7. The instrument of claim 6 wherein said first and said second means for securing said clip each include a stop, said stops each being guide channel indentations extending from said first passage.

8. A writing instrument comprising, a first writing member, a tubular casing movably housing said first writing member, said casing having a lengthwise axis and having a front portion and a rear portion, said front portion having an opening at a tip, said casing having a lateral slot extending parallel to said axis, a slidable pocket clip having a cantilevered arm retractably extending from said lateral slot parallel to said axis, said first writing member being axially movable in said front portion of the casing and having an extremity in contact with said pocket clip, said pocket clip having a plurality of guide tabs, said cantilevered arm extending from a first side of said pocket clip and said guide tabs extending from at least one side of said pocket clip perpendicular to said first side, a plurality of recessed guide channels associated with said casing, said guide channels disposed to accept said guide tabs of the pocket clip whereby motion of said pocket clip moves said first writing member in an axial direction, biasing means for urging said pocket clip in a direction substantially perpendicular to said casing axis, and a means for releasably locking said pocket clip in at least two positions, said pocket clip having a first write position wherein said cantilevered arm is retracted into said lateral slot and said first writing member has a head extending from said opening of the casing front portion, said pocket clip having an off position wherein said cantilevered arm extends from said casing and said first writing member is retracted into said casing, said means for releasably locking said pocket clip including a first write position stop in at least one guide channel.

9. The instrument of claim 8 wherein the first writing member is an ink tube.

10. The instrument of claim 8 wherein the first writing member is a pencil member and said guide channels are elongated in a direction parallel to the casing axis, thereby increasing the distance from the channel end nearest to the first writing member to the first write position stop.

11. The instrument of claim 8 wherein said biasing means includes at least one spring member biasing said clip in a direction toward said lateral slot, at least some of said guide channels having stops , said stops being indentations extending in the direction of said bias.

12. The instrument of claim 11 wherein said guide channels include at least one forward channel and at least one rearward channel, said forward channel having an arcuate shape extending away from said lateral slot and toward said front portion of the casing, said rearward channel having a linear back segment joining a forward arcuate segment extending away from said lateral slot and toward said front portion of the casing.

13. The instrument of claim 8 having a second writing member housed in an axially movable manner within said rear portion of said casing, said rear portion having an opening at a tip, said second writing member having an end in contact with said pocket clip, said guide channels each having a first passage parallel to said casing axis whereby motion of said pocket clip moves said second writing member in an axial direction, said first passages each having a first means for securing said pocket clip in said first write position and having a second means for securing said pocket clip in a second write position wherein said cantilevered arm is retracted into said casing and said second writing member extends from said opening in the rear portion of the casing, said guide channels each having a second passage perpendicular to said first passage disposed to releasably lock said clip in said off position when said guide tabs are fitted into said second passage.

14. The instrument of claim 13 wherein said biasing means includes at least one spring member biasing said pocket clip in a direction perpendicular to said casing axis, said first passage having said first write position stop and having a second write position stop associated with said second write position.

15. The instrument of claim 14 wherin said first write position stop is an indentation in said first passage extending in the direction of said cantilevered arm and said second write position stop has a shape substantially identical to said first write position stop.

* * * * *

UNITED STATES PATENT AND TRADEMARK OFFICE

CERTIFICATE OF CORRECTION

PATENT NO. : 4,717,275

DATED : January 5, 1988

INVENTOR(S) : Dietmar Burkhardt, Jr.

It is certified that error appears in the above—identified patent and that said Letters Patent is hereby corrected as shown below:

Column 1, lines 22-23, "will use a pen and a pencil alternatively" should read - -will use a pen and a pencil alternatingly- -.

Column 1, line 23, "pens of varyign colored ink" should read - -pens of varying colored ink- -.

Column 2, lines 57-58, "in actually becomes" should read - -in actuality becomes- -.

Column 2, lines 60-61, "Each front guide tab 27 into a front guide channel 31" should read - -Each front guide tab 27 fits into a front guide channel 31- -.

Column 4, line 4, "Guide tabls 69" should read - -Guide tabs 69- -

Column 4, line 45, "tip 81. this lead" should read - -tip 81. This lead- -.

Column 4, line 49, "plates ehich are fitted" should read - -plates which are fitted- -.

Claim 15, column 7, line 7, "wherin" should read - -wherein- -.

UNITED STATES PATENT AND TRADEMARK OFFICE

CERTIFICATE OF CORRECTION

PATENT NO. : 4,717,275

DATED : January 5, 1988

INVENTOR(S) : Dietmar Burkhardt, Jr.

It is certified that error appears in the above-identified patent and that said Letters Patent is hereby corrected as shown below:

In the Abstract of the Disclosure, the sentence "Stops in the guide channel secure the pocket clip." should be inserted after the last sentence ending "into the casing."

Signed and Sealed this

Ninth Day of August, 1988

*Attest:*

*Attesting Officer*

DONALD J. QUIGG

*Commissioner of Patents and Trademarks*